US005488753A

United States Patent [19]

Menegatto

[11] Patent Number: 5,488,753

[45] Date of Patent: Feb. 6, 1996

[54] YARN SUCTION DEVICE IN TEXTILE MACHINES

[75] Inventor: Carlo Menegatto, Milan, Italy

[73] Assignee: Menegatto S.r.l., Milan, Italy

[21] Appl. No.: 363,524

[22] Filed: Dec. 23, 1994

[30] Foreign Application Priority Data

Dec. 24, 1993 [IT] Italy ..... MI93A2731

[51] Int. Cl.[6] ..... D01H 9/14

[52] U.S. Cl. ..... 15/301; 15/309.1; 242/35.5 A

[58] Field of Search ..... 15/300.1, 301, 15/309.1, 310; 242/18 AA, 35.5 A, 35.6 R; 57/22, 261, 263, 305

[56] References Cited

U.S. PATENT DOCUMENTS

| | | | |
|---|---|---|---|
| 2,946,174 | 7/1960 | Bahnson | 242/18 AA X |
| 2,976,668 | 3/1961 | Reiterer | 57/305 |
| 3,270,397 | 9/1966 | Ingham et al. | 15/309.1 X |
| 3,628,213 | 12/1971 | Ramo | 15/301 X |
| 4,026,095 | 5/1977 | Kobatake et al. | 57/305 X |
| 4,346,497 | 8/1982 | Rohner et al. | 15/301 |
| 4,565,062 | 1/1986 | Nickolay | 57/305 |
| 5,423,170 | 6/1995 | Damman et al. | 15/301 X |

*Primary Examiner*—Chris K. Moore
*Attorney, Agent, or Firm*—Young & Thompson

[57] ABSTRACT

Device for the suction of yarn in textile machines, of the type comprising a conduit, maintained in a vacuum, for suction and transport of the yarn, an external mouth for trapping the yarn connected to said main vacuum conduit, and means of controlling suction of the yarn comprising a cylinder having an internal chamber and a piston for controlling suction moving longitudinally in said chamber of said cylinder and having an internal transverse hole open at its ends for connecting said yarn trapping mouth with said suction conduit.

7 Claims, 2 Drawing Sheets

YARN SUCTION DEVICE IN TEXTILE MACHINES

FIELD OF THE INVENTION

The present invention relates to a device for the suction of yarn, intended for waste, in textile machines. The device is of the type comprising a main vacuum conduit for the suction and conveying of the yarn towards a waste tank, an external mouth for trapping the yarn provided in a position suitable for the textile machine and means of controlling suction of the yarn arranged between said trapping mouth and said main vacuum conduit designed to actuate suction of the yarn through said trapping mouth by creating a vacuum above said trapping opening.

BACKGROUND OF THE INVENTION

Suction devices of the type referred above are already known. For example, devices are known which provide a connection conduit between said trapping mouth and said yarn suction conduit which has a winding and complex configuration, aimed at creating a vacuum in an area upstream of said trapping mouth by injecting pressurised air into the secondary connection conduit mentioned.

Said device is disadvantageous in various respects. Above all it has an excessively complex configuration which entails appreciable manufacturing costs. Moreover, said known device has the disadvantage that a considerable quantity of pressurised air has to be supplied to be injected inside the winding connection conduit with the aim of creating a sufficient suction pressure inside said conduit such as to aspirate the yarn towards the main vacuum conduit.

This entails the use of considerable quantities of compressed air, compressed up to a high pressure value. Said use is too onerous, both due to the excessive use of energy for compression and due to the cost of the relevant compression equipment to be made available for compressing such considerable quantities of air.

The use of such a device also involves a disadvantageous drop in the vacuum pressure inside said main suction conduit. This disadvantage is even more damaging inside textile machines wherein a main vacuum suction conduit is connected to several yarn trapping mouths. The drops in vacuum pressure caused by injecting compressed air lead to a considerable drop in the pressure inside said main conduit with resulting malfunctioning of the yarn suction which may even totally eliminate the suction pressure thus making it impossible to use the suction system itself.

With the use of such a type of device for controlling suction inside yarn suction systems in textile machines, on the one hand either the number of trapping mouths which can be connected to said main conduit has to be limited, restricting the flexibility of use of the suction system, or, on the other hand, the value of the vacuum pressure applied inside the suction system has to be forced to increase, again with the need to use excessive quantities of energy for the appropriate equipment which creates said vacuum, the latter having to be more powerful and sophisticated and hence more expensive.

The object of the present invention is that of providing a yarn suction device for textile machines which avoids the disadvantages presented by known devices. More particularly the object of the present invention is to provide a device for yarn suction in textile machines which, although actuated by a pressurised fluid, avoids the use of excessive quantities of compressed air of known devices.

Another object of the present invention is that of providing a device for yarn suction in textile machines which has a simple structural configuration with low cost.

SUMMARY OF THE INVENTION

The previous objects are achieved with a device for yarn suction which has the characterising features of claim 1.

With such a type of suction device it is possible to achieve separation between the pressurised fluid driving said piston for controlling the yarn passage opening and the vacuum fluid inside said vacuum conduit, involving the use of small quantities of compressed air which is required only for moving said control piston towards the yarn suction position and maintaining it in said position.

It is moreover simple in structure compared to devices known in the art.

The present invention will however be made clearer on reading the following description relating to a preferred embodiment given purely by way of a non-limiting example of the claimed principle.

BRIEF DESCRIPTION OF THE DRAWINGS

Said description has to be read with reference to the accompanying drawings, in which.

DESCRIPTION OF THE PREFERRED EMBODIMENT

Figure 1:
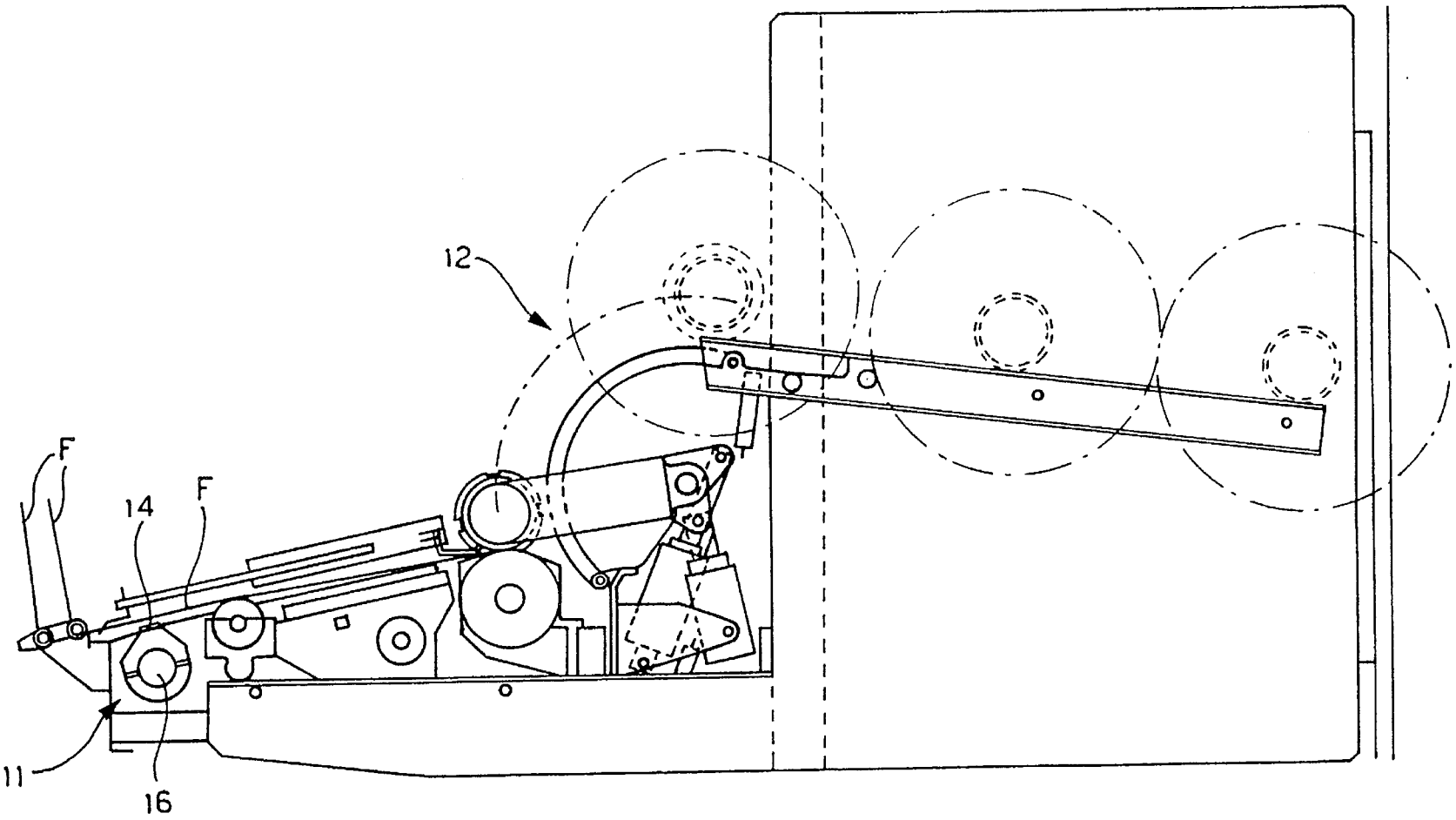
FIG. 1 represents a side view of a textile machine, namely a winding device, whereto the device of the present invention is attached.

For convenience of description, in the figures the same parts will bear the same reference numerals.

FIG. 1 illustrates the application of the suction device of the present invention to a textile machine, more particularly to winding equipment. In said FIG. 1, the suction device 11 is situated in a zone in front of the yarn winding device 12. The purpose of yarn suction devices in automated textile machines is that of trapping and conveying, towards containers of waste, yarn which has been broken or cut and which may therefore obstruct the normal working of the machine parts.

In the example case in FIG. 1, in order not to interrupt the normal working cycle of the machines arranged upstream of the winding equipment when the reel is automatically changed, the yarn F, which is continuously fed to the yarn collection reel, has to be cut and removed without interruption from the work area to special containers (not shown in the figures).

The yarn is therefore taken from the work area through a trapping mouth 14 and transported via a main conduit 16 towards said waste collection containers.

Figure 2:
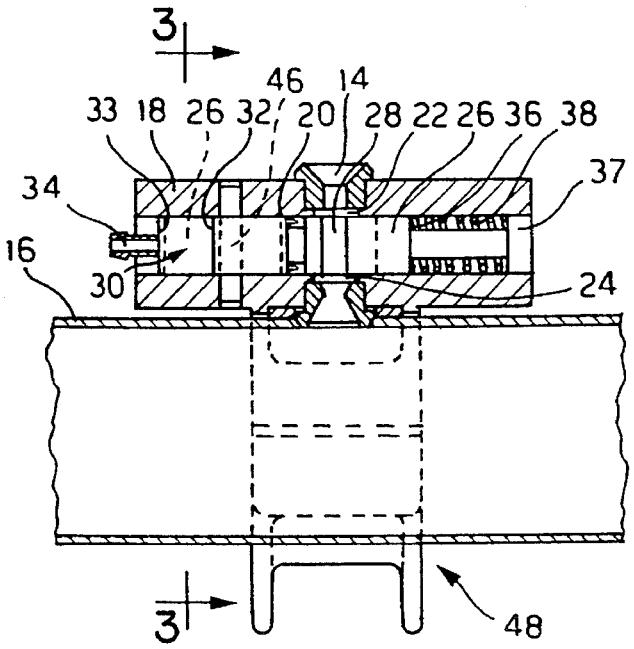
FIG. 2 represents a longitudinal section view of the preferred embodiment of the present invention.
Figure 3:
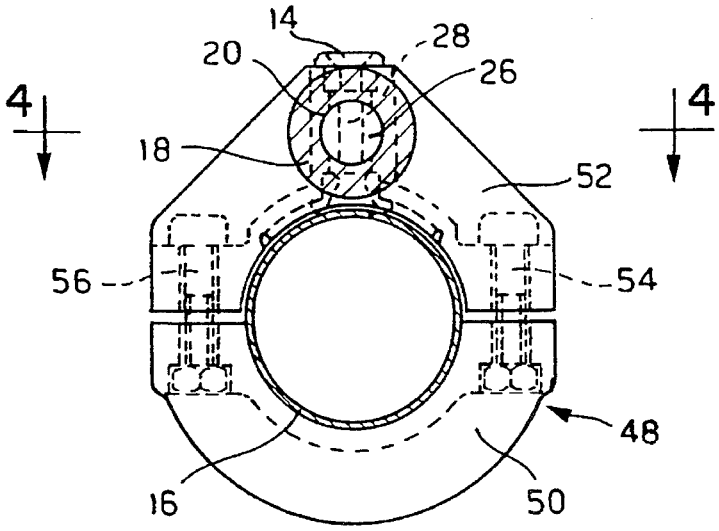
FIG. 3 represents however a cross section of the preferred embodiment taken along line 3—3 of FIG. 2.

As is clearer from FIGS. 2 and 3, the device for the suction of said yarn comprises said trapping mouth 14, said yarn suction and transport conduit 16, which, in order to create an area of suction of the yarn above the trapping opening, is maintained in a vacuum condition, that is to say with an internal pressure value lower than atmospheric pressure, and suitable means which connect said trapping mouth 14 with said main vacuum suction conduit 16.

According to the invention said means of connection between said mouth 14 and said main suction conduit 16 comprise a cylindrical body 18 arranged between said mouth 14 and said suction conduit 16, which has an internal surface defining a cylindrical chamber 20 connected via a first opening 22, made in the transverse wall of the cylinder, to said trapping mouth 14 and via a second opening 24, made in the wall opposite said first opening 22, to said suction conduit 16.

A piston 26 for controlling suction of the yarn slides inside said cylindrical chamber 20. Said control piston 26 is in the form of an elongated cylindrical element which has an external diameter corresponding to the diameter of the internal chamber 20 of said cylinder 18 and also has an internal transverse hole 28 open at its ends, designed to connect said first opening 22 with said second opening 24.

Said piston 26 is driven to move between a first position wherein said hole 28 connects said openings 22 and 24 and at least one second position (shown by the dotted line in FIG. 2) wherein the hole 28 is not aligned with said openings 22, 24 and the piston 26 plugs and closes said connection between the trapping mouth 14 and the suction conduit 16.

The vacuum of the suction conduit 16 is such that it is sufficient to connect said conduit 16 with said suction mouth 14 so that a vacuum area is created above said opening which is sufficient for aspirating and trapping the yarn.

An advantageous arrangement of the through hole 28 and of the opposite connection openings 22, 24 foresees said connection openings 22, 24 coaxial one to the other with said through hole 28, rectilinear and orthogonal to the longitudinal direction of sliding of the piston 26. In this way the yarn suction path between said trapping mouth 14 and said conduit 16 is reduced to a minimum and a greater vacuum upstream of said mouth 14 and greater efficiency of aspirating the yarn are achieved.

The means of driving the movement of the piston between the two positions described above comprise a compression chamber to the rear of the piston 30 defined inside said internal chamber 20 of the cylinder 18 and between a rear face 32 of the piston 26 and a rear transverse wall 33 of the cylinder which is connected, by means of a rear opening 34, to a supply source of a pressurised fluid (not shown) capable of providing, when required, a sufficient pressure for moving said piston 26 forwards so as to align the through hole 28 with the two openings 22, 24.

In contrast with the suction control pressure provided in said compression chamber 30, on the opposite side of the piston, between the front transverse face 36 of the piston and the front transverse wall 37 of said cylinder 18, a spiral resistance spring 38 is provided which, when there is no pressure inside said chamber 30, pushes the piston 26 into a backward position and moves away the through hole 28 of said openings 22, 24 in such a way that the piston 26 closes the connection between said mouth 14 and the conduit 16 and interrupts suction of the yarn.

It is wholly clear that for the present invention the pressure for controlling suction of the yarn, being withheld and confined inside the compression chamber 30, cannot in any way enter the vacuum suction cylinder 16, thus preventing vacuum pressure drops which occur in traditional devices.

Figure 4:
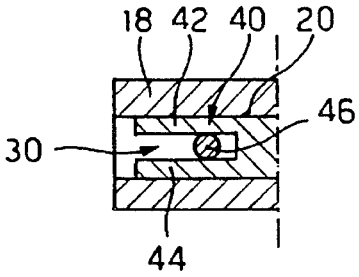
FIG. 4 represents a view from above of a detail in section of the preferred embodiment of the present invention, relating to means for guiding the control piston.

As can be seen from FIG. 4, the piston 26 for controlling suction of the yarn in order to maintain the through hole 28 perfectly aligned with said connection openings 22, 24 respectively with said trapping mouth 14 and said suction conduit 16, is guided in its longitudinal sliding inside the chamber 20 by suitable guide means. According to the invention these guide means consist of a fork element 40 which extends longitudinally to the rear of said piston 26 inside said pressure chamber 30, which has two parallel and distanced arms 42, 44, and a transverse pin 46 attached to the cylinder 18 inside said first pressure chamber 30 and which is inserted between said arms 42, 44 of said fork element 46 so that the internal surfaces of the latter during the stroke of the piston 26 slide on said pin and maintain the piston always in the same angular position.

The figures also show a bracket 48 for assembling various components of the device and for attaching the assembly to the textile machine. Said bracket 48 comprises jaws 50, 52 held together by pairs of screws and bolts 54, 56 on the opposite sides of the latter.

It is understood that what has been written and shown in the accompanying drawings with reference to the preferred embodiment of the invention has been given purely by way of a non-limiting example of the innovative principle claimed.

What is claimed is:

1. Device for the suction of yarn in a textile machine, of the type comprising a main yarn suction and transport conduit maintained in a vacuum, an external mouth for trapping the yarn connected to said main vacuum conduit, and means of controlling suction of the yarn arranged between said trapping mouth and said main suction conduit, wherein said means of controlling suction of the yarn comprise a cylinder having an internal surface defining an internal chamber of the cylinder, and having a first transverse opening connected to said trapping mouth and a second transverse opening connected to said main yarn suction conduit, and a piston for controlling suction moving longitudinally in said chamber of said cylinder in the form of an elongated body having an internal transverse hole open at its ends designed to connect said first and said second openings in the transverse wall of the cylinder for suction of the yarn, means also being provided for driving the movement of said piston between a first yarn suction position wherein said through hole is positioned between, and connects, said first and said second openings of the cylinder and at least one second position of closure wherein said piston closes the passage between said first and said second openings, and wherein means are provided for guiding the sliding of the piston inside said chamber to maintain said through hole of the piston aligned with said first and second openings.

2. Device for the suction of yarn in a textile machine according to claim 1, wherein said first and second openings are respectively on opposite transverse walls of the cylinder.

3. Device for the suction of yarn in a textile machine according to claim 2, wherein said first and second opening of the cylinder are coaxial one with the other and said through hole of the piston is a rectilinear hole arranged orthogonally to the direction of sliding of said piston in said chamber of the cylinder.

4. Device for suction of yarn in a textile machine according to claim 1, wherein said means of driving the piston for controlling suction comprise a chamber of compression of the piston arranged on the rear side of said control piston defined inside the chamber for sliding of the cylinder between the rear wall of the cylinder and the rear face of said piston and connected to a source of pressurised fluid, and elastic resistance means acting on the piston in the opposite direction to the pressure in said compression chamber.

5. Device for suction of yarn in a textile machine according to claim 4, wherein said elastic resistance means are arranged on the front side of said control piston between the front face of said piston and the front wall of said cylinder.

6. Device for suction of yarn in a textile machine according to claim 1, wherein said means for guiding the control piston comprise on the piston a fork element having two parallel arms distanced one from the other which extend longitudinally starting from an end transverse wall of said piston and, on the cylinder, a pin arranged crosswise and attached inside said chamber of the cylinder designed to be inserted between said arms of said fork element.

7. A device for suction of yarn in a textile machine according to claim 6, wherein said means for guiding the yarn are arranged in said piston compression chamber.

* * * * *